US009543647B2

(12) United States Patent
Tsutsumi et al.

(10) Patent No.: US 9,543,647 B2
(45) Date of Patent: Jan. 10, 2017

(54) WIRELESS APPARATUS

(71) Applicant: KABUSHIKI KAISHA TOSHIBA, Minato-ku, Tokyo (JP)

(72) Inventors: Yukako Tsutsumi, Kanagawa (JP); Koji Akita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 34 days.

(21) Appl. No.: 14/735,423

(22) Filed: Jun. 10, 2015

(65) Prior Publication Data

US 2015/0357707 A1 Dec. 10, 2015

(30) Foreign Application Priority Data

Jun. 10, 2014 (JP) ..... 2014-120035

(51) Int. Cl.
*H01Q 3/00* (2006.01)
*H01Q 3/12* (2006.01)

(52) U.S. Cl.
CPC ..... *H01Q 3/12* (2013.01)

(58) Field of Classification Search
CPC ..... H01Q 3/12; H01Q 11/12
USPC ..... 343/761, 763, 741, 713, 744
See application file for complete search history.

(56) References Cited

U.S. PATENT DOCUMENTS 4,786,911 A * 11/1988 Svy ..... H01Q 1/30 343/707
7,019,709 B2 * 3/2006 Fukushima ..... H01Q 9/0407 343/700 MS
7,289,075 B2 * 10/2007 Kagaya ..... H01Q 1/12 343/741
2007/0198150 A1 8/2007 Kato et al.
2009/0219217 A1 * 9/2009 Kitada ..... G01R 29/105 343/703
2015/0077289 A1 3/2015 Ito et al.
2015/0171522 A1 * 6/2015 Liu ..... H01Q 19/30 343/796
2016/0011322 A1 * 1/2016 Lee ..... G01T 1/1606 348/82

FOREIGN PATENT DOCUMENTS

JP 2005258904 A 9/2005
JP 2015061207 A 3/2015

* cited by examiner

*Primary Examiner* — Peguy Jean Pierre
(74) *Attorney, Agent, or Firm* — Holtz, Holtz & Volek PC

(57) ABSTRACT

According to one embodiment, a wireless apparatus includes a first antenna and a second antenna. The first antenna is positioned on a first imaginary plane orthogonal to a rotation axis and includes a first main radiating element. The second antenna is positioned on a second imaginary plane orthogonal to the rotation axis and opposite to the first imaginary plane at a first space from the first imaginary plane and includes a second main radiating element. The second antenna is rotatable around the rotation axis and performs at least one of transmission and reception of electromagnetic wave to and from the first antenna, and at least one of the first main radiating element and the second main radiating element is displaced from the rotation axis.

10 Claims, 8 Drawing Sheets

WIRELESS APPARATUS

CROSS-REFERENCE TO RELATED APPLICATIONS

This application is based upon and claims the benefit of priority from prior Japanese Patent Application No. 2014-120035, filed Jun. 10, 2014, the entire contents of which are incorporated herein by reference.

FIELD

Embodiments described herein relate generally to a wireless apparatus.

BACKGROUND

When a fixed unit and a rotator communicate wirelessly with each other, circular polarization antennas mainly used for satellite communication and a radio frequency identification (RFID) are utilized as a transmitting antenna and a receiving antenna to prevent polarization mismatching in which polarized waves are orthogonal to each other, in spite of rotation, allowing appropriate communication at all rotation angles. However, the circular polarization antenna needs to generate two orthogonal polarized waves with the same amplitude and with 90-degree phase difference and thus has a complicated configuration.

On the other hand, linear polarization antennas and elliptic polarization antennas are mainly used for wide applications such as wireless local area networks (LANs) and can be more easily designed and manufactured than the circular polarization antenna. In view of design and manufacture costs, linear polarization antennas and elliptic polarization antennas are desirably also used for communication between the fixed unit and the rotator. As a technique using linear polarization antennas for communication between the fixed unit and the rotator, a technique is available in which a transmitting antenna is disposed in the rotator while a receiving antenna is disposed in the fixed unit so as to make a radiating element parallel to a rotation axis for wheels.

However, the antennas used for the above-described technique are assumed to be dipole antennas with rotationally symmetric radiation directivity. In both the transmitting antenna and the receiving antenna, a main radiating element is disposed along and parallel to the rotation axis. Thus, when the main radiating element is large in size, a large space is needed in a rotation axis direction to install the antenna. On the other hand, when the main radiating element is disposed in a plane perpendicular to the rotation axis direction, the space needed to install the antenna in the rotation axis direction can be made narrower. However, rotation may make polarized waves from the antennas in the fixed unit and the rotator orthogonal to each other. As a result, disadvantageously, polarization mismatching may occur, leading to a decrease in received power.

DETAILED DESCRIPTION

Figure 1A:
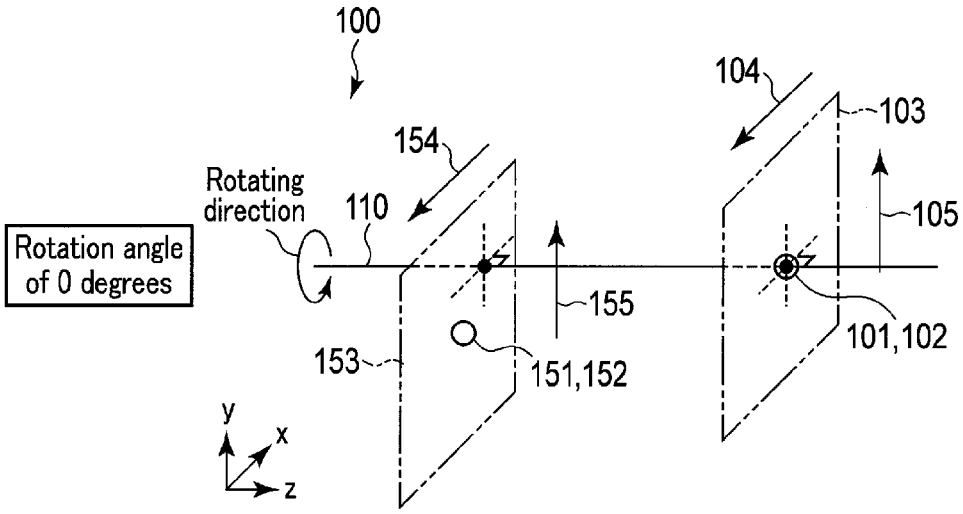
FIG. 1A is a diagram showing a wireless apparatus according to a first embodiment.

Antennas used in the above-described technique are assumed to be dipole antennas with rotationally symmetric radiation directivity, and in both a transmitting antenna and a receiving antenna, a main radiating element is disposed along and parallel to a rotation axis. Thus, when the main radiating element is large in size, a large space is needed in a rotation axis direction to install the antenna. On the other hand, when the main radiating element is disposed in a plane perpendicular to the rotation axis direction, the space in the rotation axis direction in which the antenna is installed can be made narrower. However, rotation may make polarized waves from the antennas in a fixed unit and a rotator orthogonal to each other. As a result, disadvantageously, polarization mismatching may occur, leading to a decrease in received power.

In general, according to one embodiment, a wireless apparatus includes a first antenna and a second antenna. The first antenna is positioned on a first imaginary plane orthogonal to a rotation axis and includes a first main radiating element. The second antenna is positioned on a second imaginary plane orthogonal to the rotation axis and opposite to the first imaginary plane at a first space from the first imaginary plane and includes a second main radiating element. The second antenna is rotatable around the rotation axis and performs at least one of transmission of electromagnetic wave to the first antenna and reception of electromagnetic wave from the first antenna, and at least one of the first main radiating element and the second main radiating element is displaced from the rotation axis.

Hereinafter, a wireless apparatus according to one embodiment of the present disclosure will be described in detail with reference to the drawings. In the following embodiments, the elements which perform the same operation will be assigned the same reference numeral, and redundant explanations will be omitted.

First Embodiment

A wireless apparatus according to a first embodiment will be described with reference to FIGS. 1A to 1D.

A wireless apparatus 100 according to the first embodiment includes a first antenna 101 and a second antenna 151. The first antenna 101 includes a first main radiating element 102. The second antenna 151 includes a second main radiating element 152.

The first main radiating element 102 of the first antenna 101 is positioned on a first imaginary plane 103 orthogonal to a rotation axis 110 (a Z axis direction in FIG. 1A).

The first main radiating element 102 is a portion of the first antenna 101 which radiates electromagnetic waves. The whole first antenna 101 may be the first main radiating element 102. The present embodiment assumes that the first antenna 101 is not rotated but is fixed.

The second main radiating element 152 of the second antenna 151 is positioned on a second imaginary plane 153 orthogonal to the rotation axis 110 and opposite to the first imaginary plane 103 at a predetermined space from the first imaginary plane 103. The second antenna 151 performs at least one of transmission and reception, to and from the first antenna 101, of electromagnetic waves at a frequency used.

The second main radiating element 152 is a portion of the second antenna 151 which radiates electromagnetic waves. The whole second antenna 151 may be the second main radiating element 152. The present embodiment assumes that the second antenna 151 is rotatable along the rotating direction of the rotation axis 110. Furthermore, the present embodiment assumes that electromagnetic waves are transmitted or received between the stationary first antenna 101 and the rotating second antenna 151. However, the first antenna 101 and the second antenna 151 can transmit and receive electromagnetic waves to and from each other even when the second antenna 151 is stationary.

The first embodiment assumes that the first main radiating element 102 is fixed at a position in the first imaginary plane 103 and on the rotation axis 110 and that the second main radiating element 152 is disposed at a position in the second imaginary plane 153 displaced from the rotation axis 110. In the description below, the expression "displaced" is synonymous with the expression "offset".

Furthermore, the present embodiment is not limited to the above-described disposition. The first main radiating element 102 may be offset from the rotation axis 110, and the second main radiating element 152 may be fixed to the position on the rotation axis 110, or both the first main radiating element 102 and the second main radiating element 152 may be offset from the positions on the rotation axis 110. The example in FIG. 1A illustrates a case where the second main radiating element 152 is offset from the position in the second imaginary plane 153 and on the rotation axis 110, in a negative direction on an x axis and in a negative direction on a y axis. The second antenna 151 may be rotated in a direction opposite to the rotating direction.

A formation process for the first antenna 101 and the second antenna 151 is executed integrally with the remaining part of the apparatus without distinguishing the first main radiating element 102 and the second main radiating element 152 from the remaining part. However, the main radiating element portion of the antenna is mainly involved in generation of a radiating electromagnetic field such as radiation and reception of electromagnetic waves. When the first main radiating element is a part of the antenna, an example of the portions of the antenna other than the main radiating element is wiring that connects the first main radiating element 102 to external circuits and elements. When the whole antenna is the main radiating element, the whole antenna is involved in the generation of radiating electromagnetic waves.

The first main radiating element 102 and the second main radiating element 152 according to the present embodiment are each a dipole antenna, a loop antenna, an inverse F antenna, a patch antenna, or a part or the whole of an antenna with a complicated shape. FIGS. 1A to 1D assume that the single first main radiating element 102 and the single second main radiating element 152 are provided. However, a plurality of the first main radiating elements 102 or a plurality of the second main radiating elements 152 may be provided. That is, a plurality of the first main radiating elements 102 may be present for the first antenna 101, or a plurality of the second main radiating elements 152 may be present for the second antenna 151.

Now, the positional relation between the first antenna 101 and the second antenna 151 in a case where the second antenna 151 is rotated will be described with reference to FIGS. 1A to 1D.

FIG. 1A shows a case where a co-polarization direction 104 of the first antenna 101 and a co-polarization direction 154 of the second antenna 151 are present at positions where the directions 104 and 154 are parallel to each other.

The co-polarization direction is a direction in which an electric field mainly contributing to radiation oscillates. A plane including the co-polarization direction and a propagation direction of an electromagnetic wave is referred to as a co-polarization plane. Furthermore, a direction of polarization orthogonal to the co-polarization direction is referred to as a cross-polarization direction. That is, the direction of polarization orthogonal to the co-polarization direction 104 is referred to as a cross-polarization direction 105, and the direction of polarization orthogonal to the co-polarization direction 154 is referred to as a cross-polarization direction 155. A plane including the cross-polarization direction and the propagation direction of the electromagnetic wave is referred to as a cross-polarization plane. An electromagnetic wave radiated by an electric field component oscillating in the co-polarization plane is referred to as a co-polarization component of the electromagnetic wave. Furthermore, an electromagnetic wave radiated by an electric field component oscillating in the cross-polarization plane is referred to as a cross-polarization component of the electromagnetic wave.

In FIGS. 1A to 1D, the first main radiating element 102 is illustrated as the whole first antenna 101, and the second main radiating element 152 is illustrated as the whole second antenna 151. In FIG. 1A, the co-polarization direction of the first antenna 101 and the co-polarization direction of the second antenna 151 are parallel to each other, and thus, polarization matching is established. The positional relation between the first antenna 101 and the second antenna 151 showed in FIG. 1A is assumed to correspond to a rotation angle of 0 (zero) degrees.

Figure 1B:
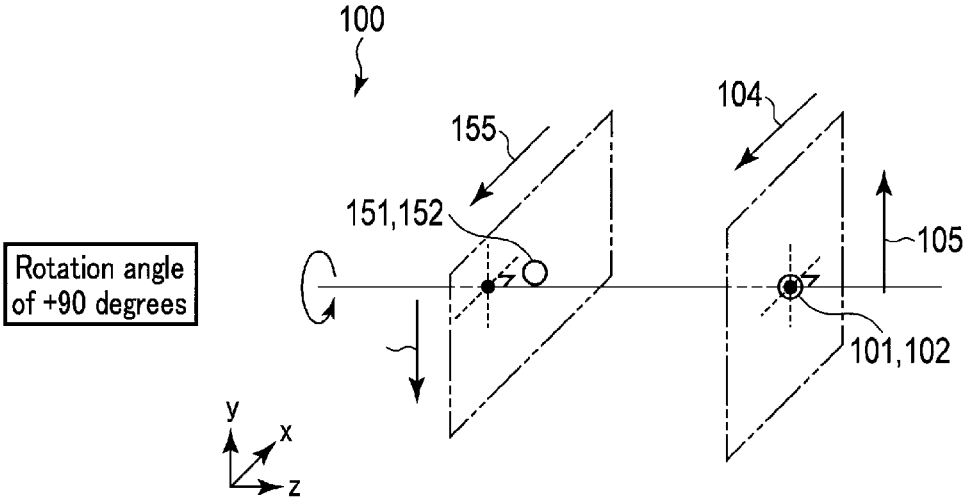
FIG. 1B is a diagram showing the wireless apparatus of FIG. 1A in which a second antenna has been rotated through 90 degrees.

FIG. 1B shows the positional relation between the first antenna 101 and the second antenna 151 in a case where the second antenna 151 has been rotated through 90 degrees in the rotating direction of the rotation axis 110.

Rotation of the second antenna 151 through 90 degrees rotates the co-polarization direction 154 of the second antenna 151 through 90 degrees. Hence, this makes the co-polarization direction 154 of the second antenna 151 perpendicular to the co-polarization direction 104 of the first antenna 101 and makes the cross-polarization direction 155 parallel to the co-polarization direction 104.

In this regard, given that the first antenna 101 and the second antenna 151 are perfect linear polarization antennas and have no cross-polarization component, polarized waves from the antennas are perfectly orthogonal to each other at positions where the rotation angle is ±90 degrees. This results in polarization mismatching, significantly reducing the received power.

However, in actuality, cross-polarization components result from asymmetry of antenna shapes, incompleteness of a power feeding system, the adverse effects of metal and a dielectric present in the vicinity of the antennas.

Nevertheless, when placed at positions on the rotation axis 110, the first antenna 101 and the second antenna 151 constantly lie face-to-face in spite of rotation. Thus, when the first antenna 101 and the second antenna 151 have no cross-polarization component in a direction parallel to the rotation axis 110, polarization mismatching occurs at positions where the rotation angle is ±90 degrees, significantly reducing the received power.

When the rotation angle is 90 degrees as showed in FIG. 1B, the second antenna 151 is offset from the position on the rotation axis 110. Thus, instead of lying face-to-face, the first antenna 101 and the second antenna 151 are located opposite to each other so as to subtend a certain angle. A cross-polarization component is more likely to be present in directions other than the directions of the first antenna 101 and the second antenna 151 than in the directions of the first antenna 101 and the second antenna 151, when the first antenna 101 and the second antenna 151 lie face-to-face. Thus, when the rotation angle is 90 degrees, the first antenna 101 and the second antenna 151 are placed opposite to each other so as to subtend the certain angle. This enables an increase in the probability that a cross-polarization component is present in the directions in which the first antenna 101 and the second antenna 151 are positioned, reducing the frequency of decreases in received power.

Figure 1C:
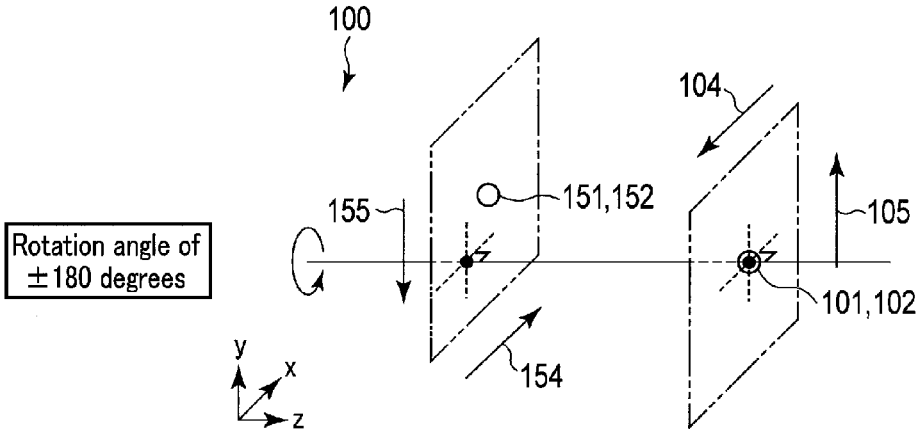
FIG. 1C is a diagram showing the wireless apparatus of FIG. 1A in which the second antenna has been rotated through 180 degrees.

FIG. 1C shows the positional relation between the first antenna 101 and the second antenna 151 in a case where the second antenna 151 has been rotated through 180 degrees in the rotating direction of the rotation axis 110.

Rotation of the second antenna 151 through 180 degrees rotates the co-polarization direction 154 of the second antenna 151 through 180 degrees, making the co-polarization direction 154 of the second antenna 151 parallel to the co-polarization direction 104 of the first antenna 101. Hence, as is the case with FIG. 1A, polarization matching is established, preventing a possible decrease in received power to allow electromagnetic waves to be efficiently transmitted or received.

Figure 1D:
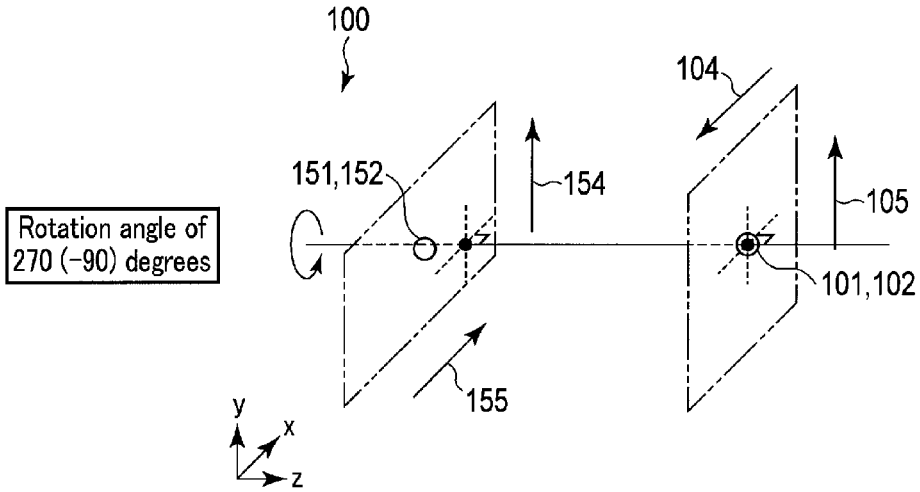
FIG. 1D is a diagram showing the wireless apparatus of FIG. 1A in which the second antenna has been rotated through 270 degrees.

FIG. 1D shows the positional relation between the first antenna 101 and the second antenna 151 in a case where the second antenna 151 has been rotated through 270 degrees (−90 degrees) in the rotating direction of the rotation axis 110.

Rotation of the second antenna 151 through 270 degrees rotates the co-polarization direction 154 of the second antenna 151 through 270 degrees. Hence, as is the case with FIG. 1B, the co-polarization direction 154 of the second antenna becomes perpendicular to the co-polarization direction 104 of the first antenna 101, and the cross-polarization direction parallel to the co-polarization direction 104. Also in this case, the second main radiating element 152 is present at a position offset from the rotation axis 110. Consequently, this enables an increase in the probability that electromagnetic waves can be transmitted or received using cross-polarization components, reducing the frequency of decreases in received power.

The first main radiating element 102 and the second main radiating element 152 are desirably displaced from each other so as not to overlap as viewed in the rotation axis 110 direction. This disposition increases the distance between the first main radiating element 102 and the second main radiating element 152. Thus, even when the second antenna 151 has a cross-polarization component at an angle away from the rotation axis 110 (in a direction close to an xy plane), the frequency of decreases in received power can be reduced when the rotation angle is 90 degrees and when the rotation angle is 270 degrees (that is, cases of ±90 degrees).

According to the first embodiment described above, at least one of the first and second main radiating elements is offset from the rotation axis. Thus, even when the co-polarization directions of the transmitting antenna and the receiving antenna are orthogonal to each other and are parallel to the cross-polarization direction, the frequency of decreases in received power can be reduced. Moreover, the first main radiating element and the second main radiating element are disposed in planes orthogonal to the rotation axis. Consequently, even when the main radiating element of the antenna is large in size, the space in the rotation axis direction needed for installation of the antenna can be reduced, allowing space to be saved.

Second Embodiment

A second embodiment is different from the first embodiment in that a board and a wireless unit are disposed in an imaginary plane in which an antenna is disposed. This allows the space opposite which an antenna is located to be saved.

Figure 2:
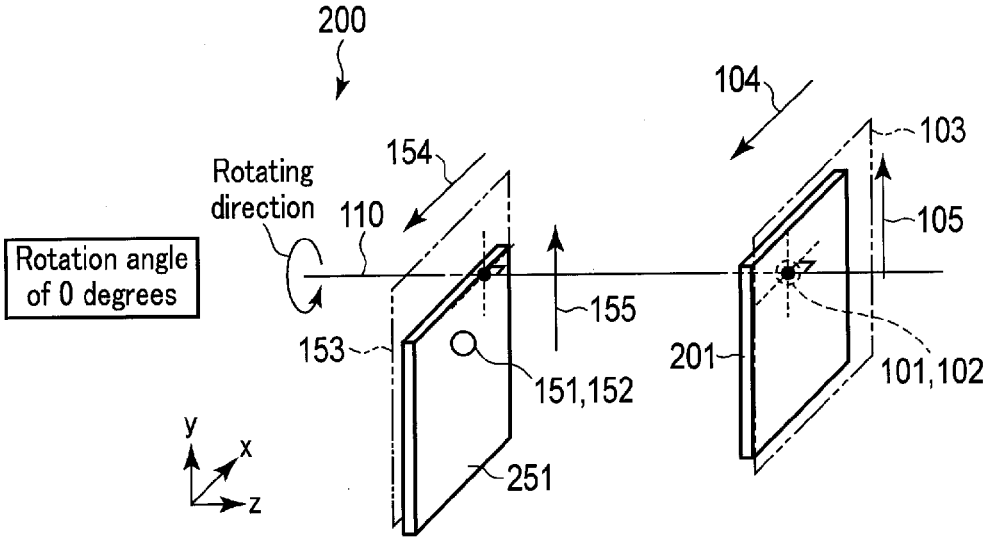
FIG. 2 is a diagram showing a wireless apparatus according to a second embodiment.

A wireless apparatus according to the second embodiment will be described with reference to FIG. 2.

A wireless apparatus 200 according to the second embodiment includes a first antenna 101, a first main radiating element 102, a second antenna 151, a second main radiating element 152, a first board 201, and a second board 251. The first antenna 101, the first main radiating element 102, the second antenna 151, and the second main radiating element 152 are similar to the first antenna 101, the first main radiating element 102, the second antenna 151, and the second main radiating element 152 in the first embodiment and will thus not be described below.

The first board 201 is disposed parallel to a first imaginary plane 103, and the first main radiating element 102 is disposed on the first board 201.

The second board 251 is disposed parallel to a second imaginary plane 153, and the second main radiating element 152 is disposed on the second board 251. The second main radiating element 152 is disposed on the second board 251 at a position offset from a rotation axis 110.

When the first main radiating element 102 and the second main radiating element 152 are placed parallel to the first imaginary plane 103 and the second imaginary plane 153, respectively, the first main radiating element 102 is formed parallel to the first board 201, and the second main radiating element 152 is formed parallel to the second board 251. Thus, the main radiating element can be easily placed parallel to the imaginary plane. Moreover, additional space in the rotation axis direction at the time of placement of the board can be minimized.

A configuration is possible in which a wireless unit is further provided on the first board 201 and on the second board 251.

Another example of the wireless apparatus according to the second embodiment including the wireless unit will be described with reference to FIGS. 3A to 3D.

A wireless apparatus 300 showed in FIGS. 3A to 3D includes a first wireless unit 301 and a second wireless unit 351, in addition to the wireless apparatus 200 according to the second embodiment.

The first wireless unit 301 is disposed on the first board 201 to execute signal processing such as a transmission process or a reception process for wireless communication.

The second wireless unit 351 is disposed on the second board 251 to execute signal processing such as a transmission process or a reception process for wireless communication.

The wireless transmitting or receiving processes executed by the first wireless unit 301 and the second wireless unit 351 are based on, for example, a function to process signals input to the respective antennas or a function to process signals from the respective antennas. The first wireless unit 301 and the second wireless unit 351 each configure, for example, a combination of an integrated circuit or discrete components. Furthermore, in FIGS. 3A to 3D, the first wireless unit 301 and the second wireless unit 351 are each illustrated as a single component. However, the first wireless unit 301 and the second wireless unit 351 may be packaged or modularized or the integrated circuit or the discrete components may be exposed.

Figure 3A:
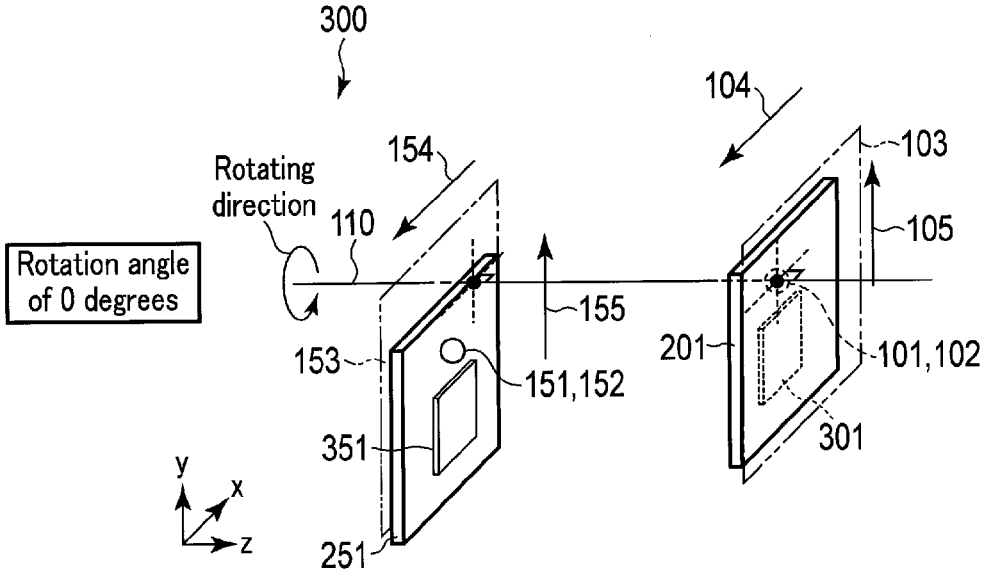
FIG. 3A is a diagram showing another example of the wireless apparatus according to the second embodiment.

In the wireless apparatus 300 showed in FIG. 3A, the first main radiating element 102 and the second main radiating element 152 are illustrated separately from the first wireless unit 301 and the second wireless unit 351, respectively. However, the first antenna 101 and the second antenna 151 may be incorporated into the packaged or modularized first wireless unit 301 and second wireless unit 351, respectively.

FIG. 3A shows a case where the positional relation between the first antenna 101 and the second antenna 151 is 0 (zero) degrees. As is the case with FIG. 1A, polarization matching is established, preventing a possible decrease in received power to allow electromagnetic waves to be efficiently transmitted or received.

Figure 3B:
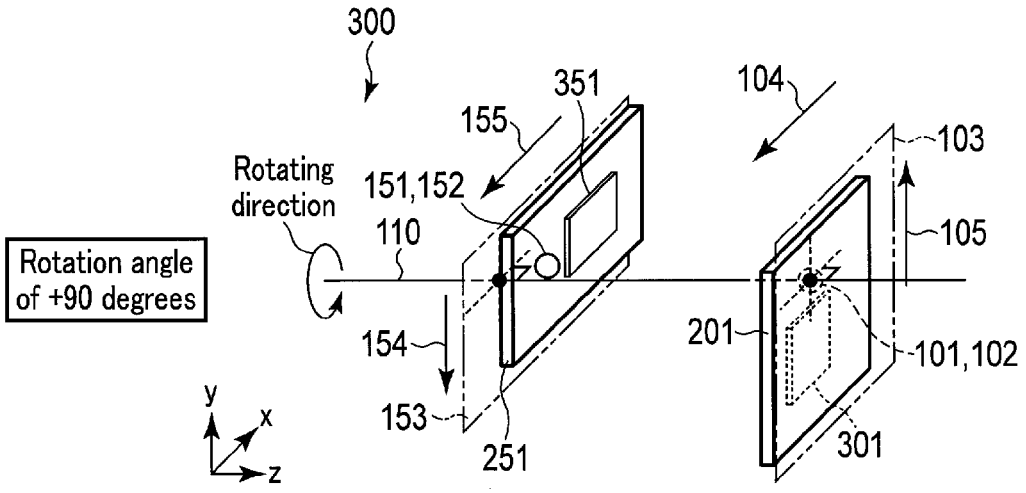
FIG. 3B is a diagram showing the wireless apparatus of FIG. 3A in a case where a second antenna has been rotated through 90 degrees.

FIG. 3B shows the positional relation between the first antenna 101 and the second antenna 151 in a case where the second antenna 151 has been rotated through 90 degrees in the rotating direction of the rotation axis 110. As is the case with FIG. 1B, the second main radiating element 152 is offset from the rotation axis 110, enabling a reduction in the frequency of decreases in received power.

Figure 3C:
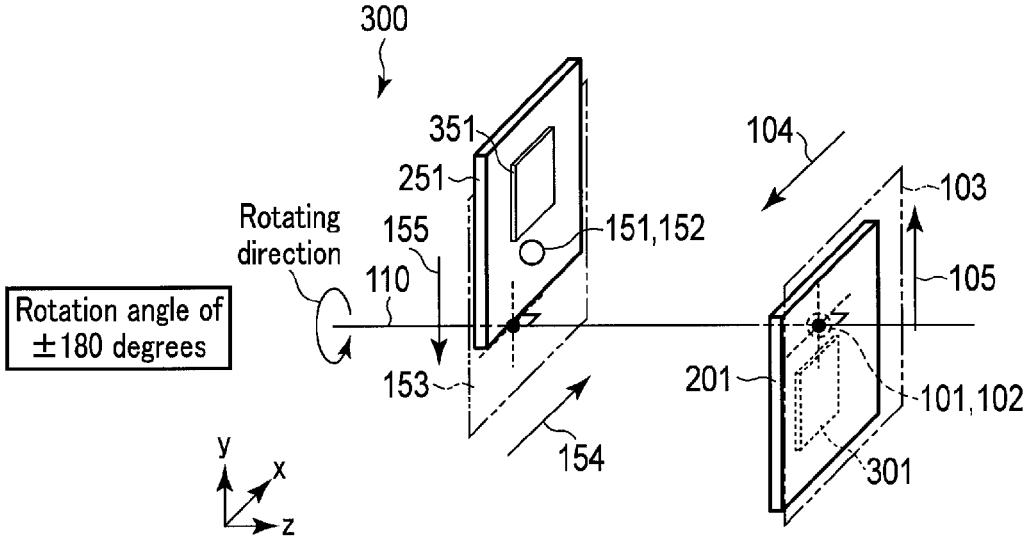
FIG. 3C is a diagram showing the wireless apparatus of FIG. 3A in a case where the second antenna has been rotated through 180 degrees.

FIG. 3C shows the positional relation between the first antenna 101 and the second antenna 151 in a case where the second antenna 151 has been rotated through 180 degrees in the rotating direction of the rotation axis 110. As is the case with FIG. 1C, polarization matching is established, preventing a possible decrease in received power to allow electromagnetic waves to be efficiently transmitted or received.

Figure 3D:
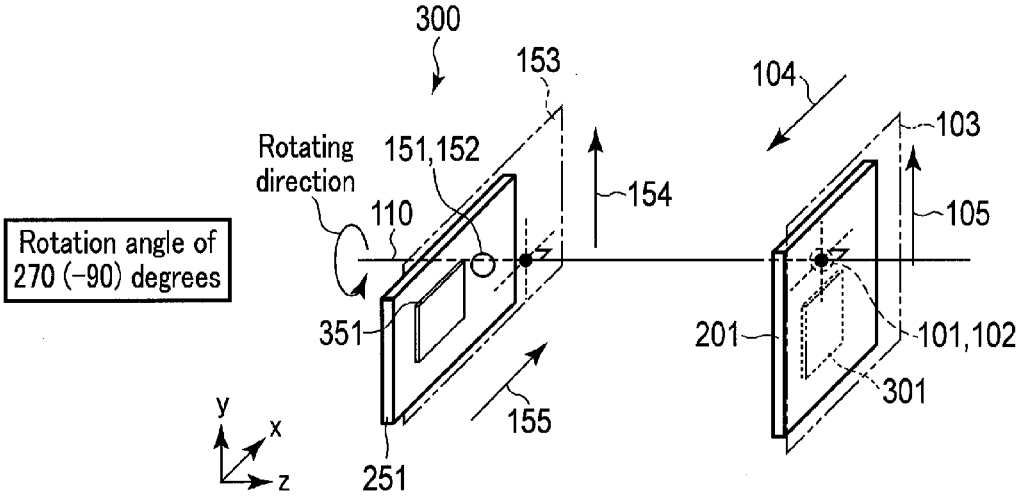
FIG. 3D is a diagram showing the wireless apparatus of FIG. 3A in a case where the second antenna has been rotated through 270 degrees.

FIG. 3D shows the positional relation between the first antenna 101 and the second antenna 151 in a case where the second antenna 151 has been rotated through 270 degrees in the rotating direction of the rotation axis 110. As is the case with FIG. 1D, the second main radiating element 152 is present at a position offset from the rotation axis 110, enabling a reduction in the frequency of decreases in received power.

According to the second embodiment described above, the board is disposed parallel to the imaginary plane, and the main radiating element is formed on the board. Thus, the main radiating element of the antenna can be easily fixed parallel to the imaginary plane, with the additional space in the rotation axis direction minimized. Moreover, the wireless unit is disposed on the board to enable a reduction in the distance between the main radiating element and the wireless unit and thus in signal loss. Furthermore, the board is utilized not only for disposition of the main radiating element of the antenna but also for disposition of the wireless unit. This eliminates the need for another board on which the wireless unit is disposed, enabling space saving. In addition, when a component different from the wireless unit is to be disposed on a board, more efficient disposition of components is achieved, enabling space saving.

Third Embodiment

A third embodiment is different from the above-described embodiments in that, when the antennas have the characteristic that a co-polarization component of an antenna gain has a beam in the rotation axis direction, whereas a cross-polarization component of the antenna gain has a beam in a non-rotation-axis-direction, the position where the main radiating element is offset from the rotation axis is determined with a composite gain taken into account. Thus, more stable wireless communication can be performed at the time of rotation with a decrease in received power suppressed.

As showed in FIG. 1B and FIG. 1D described above, an offset position with respect to a rotation axis 110 is determined based on a composite gain obtained at positions resulting from rotation, through 90 degrees and 270 degrees, of a position with a rotation angle of 0 degrees corresponding to polarization matching; the composite gain is calculated in accordance with Expression (1).

$$(\text{Composite gain})=G_{1C}\times G_{2X}+G_{1X}\times G_{2C} \quad (1)$$

In Expression (1), $G_{1C}$ designates a co-polarization component of the antenna gain of a first antenna 101 in the direction (hereinafter also referred to as the first direction) in which a second antenna 151 is positioned as viewed from the first antenna 101. $G_{2X}$ designates a cross-polarization component of the antenna gain of the second antenna 151 in the direction (hereinafter also referred to as the second direction) in which the first antenna 101 is positioned as viewed from the second antenna 151. $G_{1X}$ designates a cross-polarization component of the antenna gain of a first antenna 101 in the direction in which the second antenna 151 is positioned as viewed from the first antenna 101. $G_{2C}$ designates a co-polarization component of the antenna gain of the second antenna 151.

At least one of the first and second main radiating elements 102 and 152 may be offset so as to orient beams of a co-polarization and a cross-polarization component of the antenna gains of the first antenna 101 opposite to beams of a cross-polarization and a co-polarization component of the antenna gains of the second antenna 151, respectively; that is, to make the composite gain calculated in accordance with Expression (1) larger.

Moreover, at least one of the first and second main radiating elements 102 and 152 may be offset so as not only to orient beams of the first antenna 101 and the second antenna 151 opposite to each other but also to set the received power in at least one of the first and second antennas 101 and 151 equal to or higher than a threshold.

Furthermore, at least one of the first and second main radiating elements 102 and 152 may be offset such that the composite gain has a value equal to or larger than a threshold at which a desired throughput is achieved in wireless communication or equal to or smaller than a threshold at which a desired error rate for wireless communication is achieved.

According to the third embodiment described above, for a rotation angle of 90 degrees or 270 degrees with respect to the position with polarization matching established, at least one of the first and second main radiating elements is offset from the rotation axis so as to orient the beams of a co-polarization and a cross-polarization component of the antenna gains of the first antenna 101 opposite to beams of a cross-polarization and a co-polarization component of the antenna gains of the second antenna 151, respectively. This enables suppression of a decrease in received power caused by orthogonal polarized waves, allowing for stable wireless communication at the time of rotation. Furthermore, at least one of the first and second main radiating elements is offset from the rotation axis so as to meet at least one of the conditions, that is, the desired received power, the desired throughput, or the desired error rate. Then, the desired received power, the desired throughput, or the desired error rate can be maintained at the time of rotation, allowing for stable wireless communication.

Fourth Embodiment

A fourth embodiment assumes a case where at least one of the first and second antennas has the characteristic that the cross-polarization component of the antenna gain is minimized in a plane including a direction parallel to the rotation axis. In such a case, both the first main radiating element and the second main radiating element are offset from the positions on the rotation axis to allow for stable wireless communication with a decrease in received power reduced.

An example of the radiation directivity characteristic of an antenna assumed in the fourth embodiment will be described with reference to FIG. 4.

Figure 4:
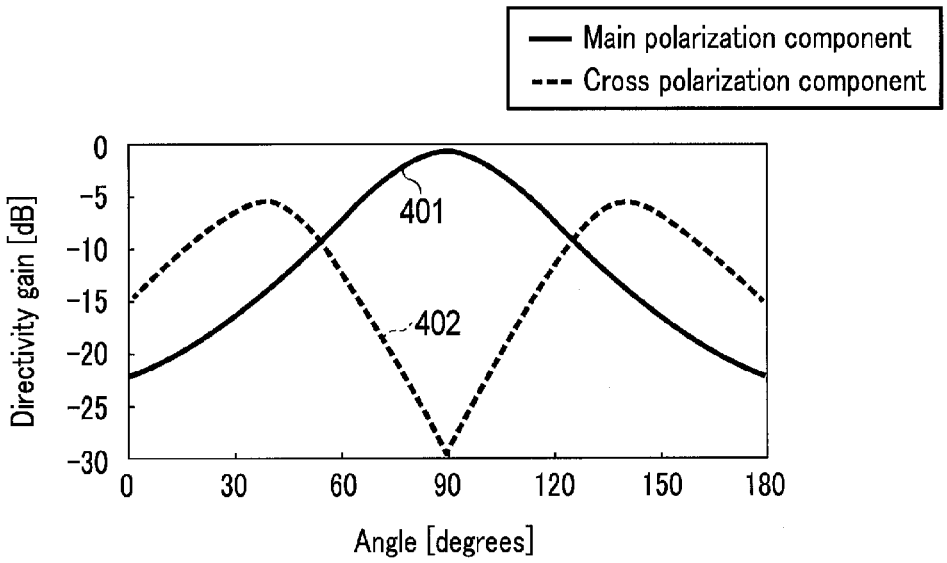
FIG. 4 is a diagram showing an example of a radiation directivity characteristic of an antenna assumed in a fourth embodiment.

Graphs showed in FIG. 4 represent the radiation directivity characteristic of the antenna observed when the antenna is disposed at an origin of an xyz coordinate system (a z axis is a rotation axis 110). The vertical axis indicates a directivity gain [dB], and the horizontal axis indicates an angle [degrees] with reference to an x axis. That is, the positive direction of the x axis indicates 0 degrees, a z axis direction that is the rotation axis 110 direction indicates 90 degrees, and the negative direction of the z axis indicates 180 degrees. A solid graph 401 represents the co-polarization component of the directivity gain. A dashed graph 402 represents the cross-polarization component of the directivity gain.

As showed in FIG. 4, in the rotation axis 110 direction at an angle of 90 degrees, a beam of the co-polarization component of the directivity gain is maximized, whereas a beam of the cross-polarization component of the directivity gain is minimized. On the other hand, in a non-rotation-axis-direction, the cross-polarization component is radiated, and cross-polarization component is maximized near angles of 45 degrees and 135 degrees.

Figure 5A:
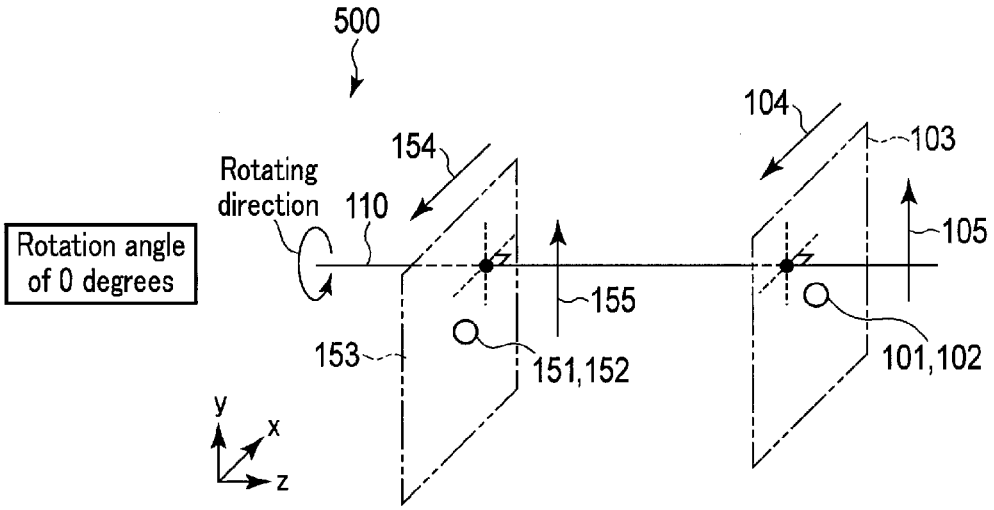
FIG. 5A is a diagram showing a wireless apparatus according to a fourth embodiment.

Now, a wireless apparatus according to the fourth embodiment will be described with reference to FIG. 5A and FIG. 5D.

A wireless apparatus 500 according to the fourth embodiment includes a first antenna 101, a first main radiating element 102, a second antenna 151, and a second main radiating element 152. The first antenna 101, the first main radiating element 102, the second antenna 151, and the second main radiating element 152 are similar to the first antenna 101, the first main radiating element 102, the second antenna 151, and the second main radiating element 152 in the first embodiment and will thus not be described below.

Figure 5B:
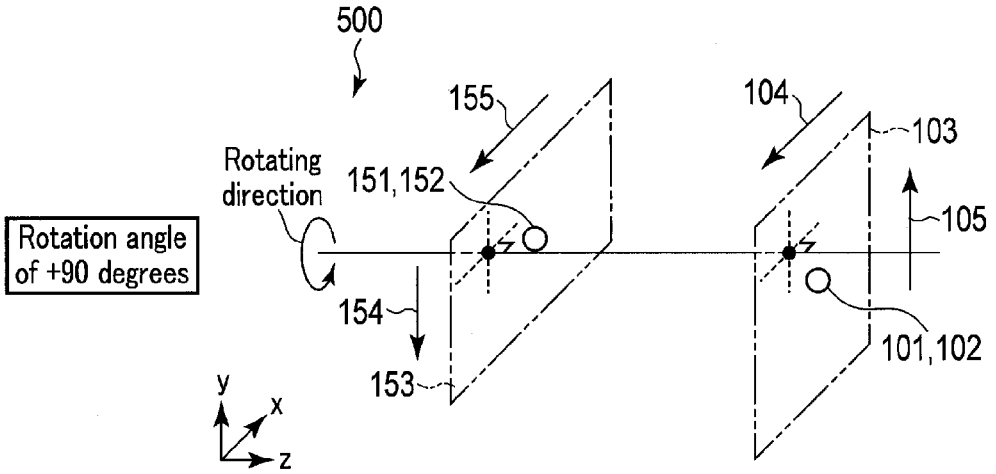
FIG. 5B is a diagram showing the wireless apparatus of FIG. 5A in a case where a second antenna has been rotated through 90 degrees.
Figure 5C:
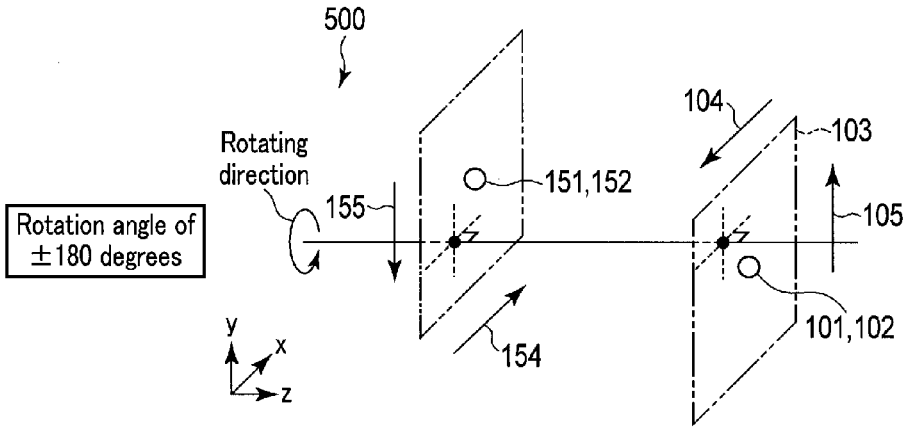
FIG. 5C is a diagram showing the wireless apparatus of FIG. 5A in a case where the second antenna has been rotated through 180 degrees.
Figure 5D:
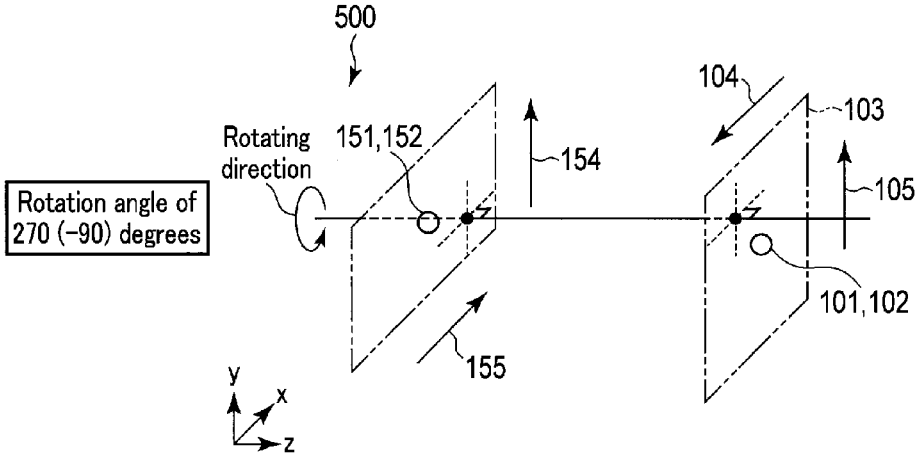
FIG. 5D is a diagram showing the wireless apparatus of FIG. 5A in a case where the second antenna has been rotated through 270 degrees.

As is the case with FIGS. 1A to 1D and FIGS. 3A to 3D, FIG. 5A shows a case of a rotation angle of 0 degrees, FIG. 5B shows a case of a rotation angle of 90 degrees, FIG. 5C shows a case of a rotation angle of 180 degrees, and FIG. 5D shows a case of a rotation angle of 270 degrees. In FIGS. 5A to 5D, both the first main radiating element 102 and the second main radiating element 152 are offset from the positions on the rotation axis 110.

The positional relation between the first antenna 101 and the second antenna 151 observed at the time of rotation in the wireless apparatus according to the fourth embodiment will be described in further detail with reference to FIG. 6.

Figure 6:
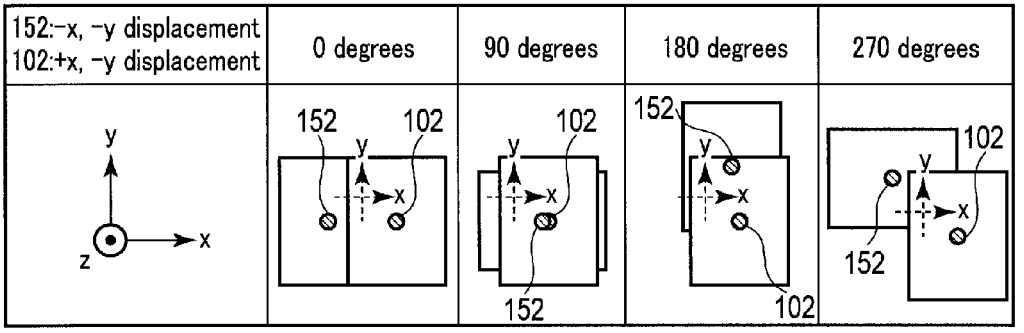
FIG. 6 is a diagram showing the positional relation between a first antenna and a second antenna at the time of rotation.

FIG. 6 shows the positional relation between the first main radiating element 102 of the first antenna 101 and the second main radiating element 152 of the second antenna 151 in the wireless apparatus 500 as viewed in the z axis direction.

The initial positions (0 degrees) of the first antenna 101 and the second antenna 151 are such that the first main radiating element 102 is placed at a position (+x, −y), whereas the second main radiating element 152 is placed at a position (−x, −y). In this regard, x and y are arbitrary positive number. The first main radiating element 102 is assumed to be fixed at (+x, −y) and to receive electromagnetic waves from the second main radiating element 152. On the other hand, the second main radiating element 152 rotates around the rotation axis 110 to transmit electromagnetic waves to the first main radiating element 102.

When the second antenna 151 is at the initial position (0 degrees), the polarization directions of the first antenna 101 and the second antenna 151 are parallel to each other as viewed in the z axis direction. Hence, electromagnetic waves can be efficiently received.

When the second antenna 151 is rotated through 90 degrees, the second main radiating element 152 is placed at the position (+x, −y). In this case, since the first main radiating element 102 is placed at the position (+x, −y), the first main radiating element 102 and the second main radiating element 152 overlap. Hence, the cross-polarization component of each antenna is null, reducing the received power.

When the second antenna 151 is rotated through 180 degrees, the second main radiating element 152 is placed at a position (+x, +y). In this case, with the first main radiating element 102 placed at the position (+x, −y) and the second main radiating element 152 placed at the position (+x, +y), the polarization directions of the first antenna 101 and the second antenna 151 are parallel to each other, allowing electromagnetic waves to be efficiently received.

When the second antenna 151 is rotated through 270 degrees, the second main radiating element 152 is placed at a position (−x, +y). In this case, the position (+x, −y) of the first main radiating element 102 and the position (−x, +y) of the second main radiating element 152 do not overlap but subtend a certain angle, as viewed in the z axis direction. The cross-polarization components of antenna gains of the first antenna 101 and the second antenna 151 have a beam in the non-rotation-axis-direction, that is, in any direction other than the z axis direction. Hence, the directions of beams of a cross-polarization component of the antenna gains of the first antenna 101 and a co-polarization component of the antenna gains of the second antenna 151 and the directions of beams of a co-polarization component of the antenna gains of the first antenna 101 and a cross-polarization component of the antenna gains of the second antenna 151 are aligned with each other to enable a decrease in received power to be reduced.

In addition, x and y may be any values as long as the corresponding position allows beams of the first antenna and the second antenna to be oriented opposite each other and also enables at least a given amount of power to be secured. When at least one of the first antenna and the second antenna is configured such that the cross-polarization component of the antenna gain is minimized in a plane including a direction parallel to the rotation axis as in the present embodiment, the values x and y are set to correspond to an equal distance from the axis, that is, set to be the same, so that the position of the first main radiating element and the position of the second main radiating element substantially overlap at a rotation angle of 90 degrees and are significantly offset from each other at a rotation angle of 270 degrees. Thus, a possible decrease in received power can be suppressed at a rotation angle of 270 degrees.

Now, an example of received power measurement results for the wireless apparatus according to the fourth embodiment will be described with reference to FIG. 7.

Figure 7:
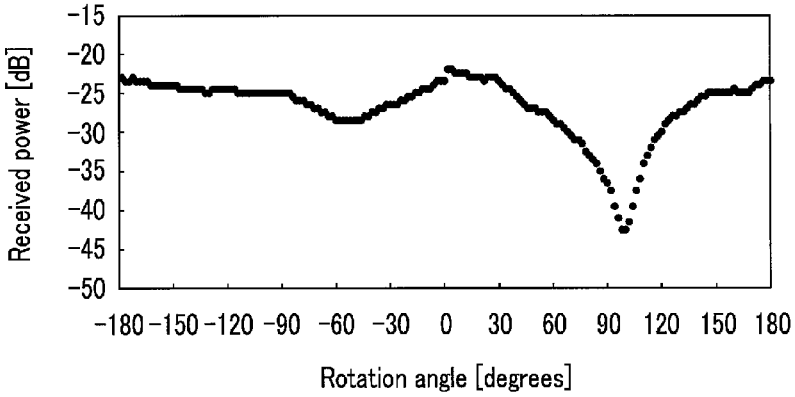
FIG. 7 is a diagram showing an example of received power measurement results.

FIG. 7 shows the results of the measurement, for each rotation angle, of power received by the first antenna 101 when one rotation of the second antenna 151 in the wireless apparatus 500 according to the fourth embodiment has been made along the rotation axis. The axis of ordinate represents a received power value [dB], and the axis of abscissas represents the rotation angle [degrees] for an initial value of 0 degrees.

As showed in FIG. 7, the received power is maximized near angles of 0 degrees and 180 degrees where polarization matching is established. When both the first main radiating element 102 and the second main radiating element 152 are offset from the rotation axis 110 and beams of the first antenna 101 and the second antenna 151 are oriented opposite to each other, the received power decreases by approximately 20 dB compared to the maximum received power near an angle of +90 degrees but the decrease from the maximum received power can be reduced to approximately 5 dB near an angle of −90 degrees (270 degrees).

According to the fourth embodiment described above, when antennas are used in which the cross-polarization component of the antenna gain is minimized in a plane including the rotation axis direction, both the first main radiating element and the second main radiating element are offset from the rotation axis such that the first antenna and the second antenna do not overlap but are oriented to subtend a certain angle when the second antenna has been rotated either through 90 degrees or through 270 degrees. Hence, a beam of the cross-polarization component of the antenna gain can be received, enabling a decrease in received power to be reduced.

Fifth Embodiment

In a fifth embodiment, a usage example of the wireless apparatus according to any of the above-described embodiments will be described.

Figure 8:
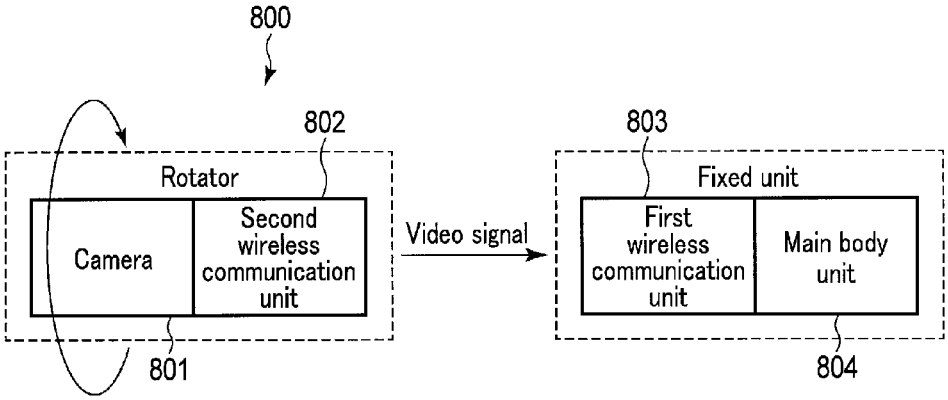
FIG. 8 is a block diagram showing wireless device including the wireless apparatus.

Wireless device including the wireless apparatus according to the present embodiment will be described with reference to a block diagram in FIG. 8.

Wireless device 800 according to the fifth embodiment includes a camera 801, a second wireless communication unit 802, a first wireless communication unit 803, and a main body unit 804. A set of the camera 801 and the second wireless communication unit 802 is referred to as a rotator. A set of the first wireless communication unit 803 and the main body unit 804 is referred to as a fixed unit. The first wireless communication unit 803 and the second wireless communication unit 802 may be configured using the wireless apparatus according to any of the above-described embodiments.

The camera 801 takes a video to generate a video signal including the taken video.

The second wireless communication unit 802 includes the second antenna 151 according to any of the above-described embodiments and receives the video signal from the camera 801 to wirelessly transmit the video signal to the first wireless communication unit 803. A wireless frequency used may be, for example, a millimeter waveband. The rotator rotates to enable videos to be taken at various rotation angles.

The first wireless communication unit 803 includes a first antenna 101 according to any of the above-described embodiments and receives the video signal from the second wireless communication unit 802.

The main body unit 804 receives the video signal from the first wireless communication unit 803 and executes processing according to an application, for example, executes an image analysis process on the video signal.

According to the fifth embodiment described above, the use of the wireless apparatus described above in the embodiments enables stable wireless communication at the time of rotation, allowing videos taken by the camera unit to be stably transmitted to the main body unit. Furthermore, the millimeter waveband has a small wavelength of several millimeters, and thus, the use of the millimeter waveband as a wireless frequency enables the antennas to be miniaturized, allowing the first wireless communication unit and the second wireless communication unit to be configured to be small. The wireless device according to the fifth embodiment may be used to transmit videos as in, for example, a monitor camera.

Comparative Example

As a comparative example of measurement results for the received power in the wireless apparatus 500 according to the fourth embodiment showed in FIG. 7, measurement results for received power in a conventional antenna disposition will be described with reference to FIG. 9.

Figure 9:
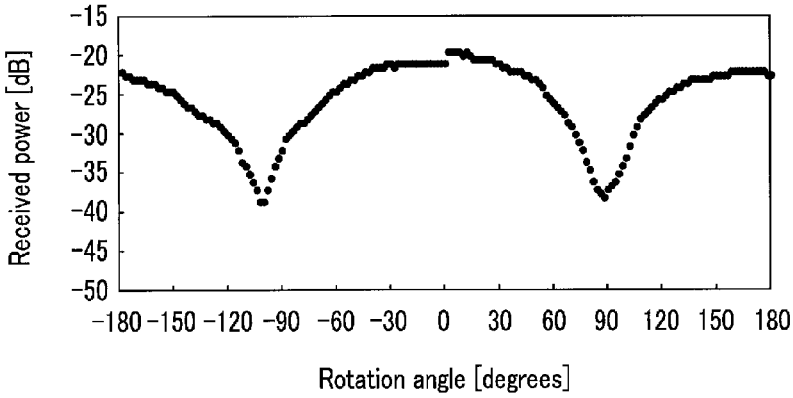
FIG. 9 is a diagram showing received power measurement results for a conventional antenna disposition.

FIG. 9 shows a case where a first antenna 101 and a second antenna in which the cross-polarization component of the antenna gain is null in the rotation axis 110 direction are both disposed at the center of the rotation axis.

As showed in FIG. 9, the received power is maximized near angles of 0 degrees and 180 degrees because of polarization matching but decreases by approximately 20 dB compared to the maximum received power near both angles of 90 degrees and −90 degrees (270 degrees). This is because co-polarized waves from the transmitting and receiving antennas are orthogonal to each other at angles of 90 degrees and −90 degrees, and the cross-polarization component is not radiated in the rotation axis direction.

On the other hand, in the wireless apparatus 500 according to the fourth embodiment, both the first main radiating element 102 and the second main radiating element 152 are offset from the rotation axis 110. Thus, at least one of the angles of 90 degrees and −90 degrees enables a decrease in received power to be reduced.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A wireless apparatus, comprising:

a first antenna that is positioned on a first imaginary plane orthogonal to a rotation axis and includes a first main radiating element; and a second antenna that is positioned on a second imaginary plane orthogonal to the rotation axis and opposite to the first imaginary plane at a first space from the first imaginary plane and includes a second main radiating element, wherein the second antenna is rotatable around the rotation axis and performs at least one of transmission of electromagnetic wave to the first antenna and reception of electromagnetic wave from the first antenna, and at least one of the first main radiating element and the second main radiating element is displaced from the rotation axis.

2. The apparatus according to claim 1, wherein the first main radiating element and the second main radiating element are positioned so as not to overlap when viewed from a direction of the rotation axis.

3. The apparatus according to claim 1, further comprising:

a first board that is arranged parallel to the first imaginary plane and on which the first main radiating element is arranged; and a second board that is arranged parallel to the second imaginary plane and on which the second main radiating element is arranged.

4. The apparatus according to claim 3, further comprising:

a first wireless unit that is arranged on the first board to execute signal processing for wireless communication; and a second wireless unit that is arranged on the second board to execute the signal processing for the wireless communication.

5. The apparatus according to claim 1, wherein the first antenna and the second antenna have a characteristic such that a co-polarization component of an antenna gain has a beam in the rotation axis direction and a cross-polarization component of the antenna gain has a beam in a non-rotation-axis-direction, and at a first position to which the second antenna is rotated from a first angle by 90 or 270 degrees, the first main radiating element and the second main radiating element are arranged such that beams of a composite gain are directed opposite to each other, the first angle being a rotation angle at a second position of the second antenna when a polarization matching is established between the first main radiating element and the second main radiating element, the composite gain resulting from addition of a first gain and a second gain, the first gain resulting from multiplication of a co-polarization component of an antenna gain of the first antenna in a first direction in which the second antenna is positioned when viewed from the first antenna by a cross-polarization component of an antenna gain of the second antenna in a second direction in which the first antenna is positioned when viewed from the second antenna, and the second gain resulting from multiplication of a cross-polarization component of the antenna gain of the first antenna in the first direction by a co-polarization component of the antenna gain of the second antenna in the second direction.

6. The apparatus according to claim 5, wherein the first main radiating element and the second main radiating element are positioned so as to set a received power no less than a first threshold, the received power being received by at least one of the first and second antennas.

7. The apparatus according to claim 5, wherein the first main radiating element and the second main radiating element are positioned so as to satisfy at least one of a throughput for wireless communication no less than a second threshold and an error rate for the wireless communication no more than a third threshold.

8. The apparatus according to claim 1, wherein at least one of the first antenna and the second antenna has a characteristic that a cross-polarization component of an antenna gain is minimized in a plane including a direction parallel to the rotation axis, and the first main radiating element and the second main radiating element are displaced from the rotation axis.

9. The wireless apparatus according to claim 8, wherein the first main radiating element and the second main radiating element are displaced from the rotation axis by a first distance in a first axis direction orthogonal to the rotation axis, and the first radiating element and the second radiating element are displaced mutually from the first axis by the first distance in a second axis direction orthogonal to the rotation axis and the first axis.

10. The apparatus according to claim 1, wherein a frequency used for wireless communication is a frequency in a millimeter waveband.

* * * * *